US012297830B2

(12) United States Patent
Arakane et al.

(10) Patent No.: US 12,297,830 B2
(45) Date of Patent: May 13, 2025

(54) SCROLL COMPRESSOR AND REFRIGERATION APPARATUS

(71) Applicant: DAIKIN INDUSTRIES, LTD., Osaka (JP)

(72) Inventors: Taiga Arakane, Osaka (JP); Naoki Shimozono, Osaka (JP); Tomomi Yokoyama, Osaka (JP); Takafumi Yamamoto, Osaka (JP)

(73) Assignee: DAIKIN INDUSTRIES, LTD., Osaka (JP)

( * ) Notice: Subject to any disclaimer, the term of this patent is extended or adjusted under 35 U.S.C. 154(b) by 0 days.

(21) Appl. No.: 18/648,038

(22) Filed: Apr. 26, 2024

(65) Prior Publication Data

US 2024/0271620 A1 Aug. 15, 2024

Related U.S. Application Data

(63) Continuation of application No. PCT/JP2022/038188, filed on Oct. 13, 2022.

(30) Foreign Application Priority Data

Oct. 28, 2021 (JP) ..... 2021-176255

(51) Int. Cl.
*F04C 14/24* (2006.01)
*F04C 15/06* (2006.01)
(Continued)

(52) U.S. Cl.
CPC ..... *F04C 18/0215* (2013.01); *F04C 15/06* (2013.01); *F04C 15/064* (2013.01);
(Continued)

(58) Field of Classification Search
CPC ..... F04C 14/24; F04C 28/24; F04C 15/06; F04C 15/064; F04C 15/066; F04C 29/12; F04C 29/124; F04C 29/126
See application file for complete search history.

(56) References Cited

U.S. PATENT DOCUMENTS 10,746,175 B2 * 8/2020 Takahashi ..... F04C 18/0215
2017/0254573 A1 * 9/2017 Numata ..... F25B 43/00

FOREIGN PATENT DOCUMENTS

CN 108691774 A * 10/2018 ..... F04B 39/1013
EP 1849968 A2 * 10/2007 ..... F01L 1/3442
(Continued)

OTHER PUBLICATIONS

EP-1849968 by PE2E May 31, 2024.*
(Continued)

*Primary Examiner* — Deming Wan
(74) *Attorney, Agent, or Firm* — GLOBAL IP COUNSELORS, LLP

(57) ABSTRACT

A scroll compressor includes a movable scroll, a fixed scroll having a suction passage, a suction pipe, and a suction check valve to open and close an open end of the suction pipe. The suction check valve includes a valve body, a valve seat, and a compression spring to bias the valve body toward the open end of the suction pipe. The valve body includes a first bottom portion, and a first circumferential wall extending toward the valve seat along a peripheral portion of the first bottom portion. The valve seat includes a second bottom portion, and a second circumferential wall extending toward the valve body along a peripheral portion of the second bottom portion. One of the first and second circumferential walls has an outside diameter smaller than an inside diameter of an open end of the other one of the first and second circumferential walls.

19 Claims, 16 Drawing Sheets

(51) Int. Cl.

| | |
|---|---|
| ***F04C 18/02*** | (2006.01) |
| ***F04C 28/24*** | (2006.01) |
| ***F04C 29/12*** | (2006.01) |
| ***F25B 31/02*** | (2006.01) |

(52) U.S. Cl.
CPC ..... *F04C 15/066* (2013.01); *F04C 29/12* (2013.01); *F04C 29/124* (2013.01); *F04C 29/126* (2013.01); *F25B 31/026* (2013.01); *F04C 2210/26* (2013.01)

(56) References Cited

FOREIGN PATENT DOCUMENTS

| | | | | |
|---|---|---|---|---|
| EP | 2 434 159 | B1 | 5/2018 | |
| JP | 50-93627 | U | 8/1975 | |
| JP | 60-142082 | A | 7/1985 | |
| JP | 62-203989 | U | 12/1987 | |
| JP | 2009-281345 | A | 12/2009 | |
| JP | 2017-115687 | A | 6/2017 | |
| JP | 2019-507862 | A | 3/2019 | |
| JP | 2020-7945 | A | 1/2020 | |
| WO | WO-2020008849 | A1 * | 1/2020 | ..... F04C 29/12 |

OTHER PUBLICATIONS

WO 2020008849 by PE2E Sep. 3, 2024.*
English translaiton of CN108691774 by PE2E Dec. 19, 2024.*
European Search Report of corresponding EP Application No. 22 88 6718.0 dated Dec. 6, 2024.
International Search Report of corresponding PCT Application No. PCT/JP2022/038188 dated Dec. 20, 2022.
International Preliminary Report of corresponding PCT Application No. PCT/JP2022/038188 dated May 10, 2024.

* cited by examiner

FIG.24

| ASHRAE Number | COMPOSITION | COMPOSITION RATIO (MASS%) |
|---|---|---|
| R513A | R1234yf/R134a | (56/44) |
| R1234yf | R1234yf | (100) |
| R513B | R1234yf/R134a | (58.5/41.5) |
| R463A | R744/R32/R125/R1234yf/R134a | (6.0/36.0/30.0/14.0/14.0) |
| R449A | R32/R125/R1234yf/R134a | (24.3/24.7/25.3/25.7) |
| R452A | R32/R125/R1234yf | (11.0/59.0/30.0) |
| R454A | R32/R1234yf | (35/65) |
| R449C | R32/R125/R1234yf/R134a | (20/20/31/29) |
| R454C | R32/R1234yf | (21.5/78.5) |
| R1336mzz(Z) | R1336mzz(Z) | (100) |
| R1336mzz(E) | R1336mzz(E) | (100) |
| R514A | R1336mzz(Z)/R1130(E) | (74.7/25.3) |
| R448A | R32/R125/R1234yf/R134a/R1234ze(E) | (26/26/20/21/7) |
| R515A | R1234ze(E)/R227ea | (88/12) |
| R515B | R1234ze(E)/R227ea | (91.1/8.9) |
| R1234ze(E) | R1234ze(E) | (100) |
| R1233zd(E) | R1233zd(E) | (100) |
| R452C | R32/R125/R1234yf | (12.5/61/26.5) |
| R449B | R32/R125/R1234yf/R134a | (25.2/24.3/23.2/27.3) |
| R1224yd(Z) | R1224yd(Z) | (100) |

SCROLL COMPRESSOR AND REFRIGERATION APPARATUS

CROSS-REFERENCE TO RELATED APPLICATIONS

This is a continuation of International Application No. PCT/JP2022/038188 filed on Oct. 13, 2022, which claims priority to Japanese Patent Application No. 2021-176255, filed on Oct. 28, 2021. The entire disclosures of these applications are incorporated by reference herein.

BACKGROUND

Technical Field

The present disclosure relates to a scroll compressor and a refrigeration apparatus.

Background Art

Japanese Unexamined Patent Publication No. 2020-007945 discloses a scroll compressor including a suction check valve that includes a valve body, a coil spring, and a support. During operation of the scroll compressor, if the force exerted on the valve body by a suction refrigerant is greater than the biasing force of the coil spring, the coil spring contracts, and the valve body thus moves away from an open end face. As a result, the refrigerant is sucked into a compression chamber.

SUMMARY

A first aspect of the present disclosure is directed to a scroll compressor including a movable scroll, a fixed scroll defining a fluid chamber together with the movable scroll and having a suction passage that guides a refrigerant to the fluid chamber, a suction pipe having one end portion inserted into the suction passage, and a suction check valve arranged in the suction passage and configured to open and close an open end of the suction pipe. The suction check valve includes a valve body configured to close the open end of the suction pipe, a valve seat arranged to face the valve body, and a compression spring arranged between the valve body and the valve seat to bias the valve body toward the open end of the suction pipe. The valve body includes a first bottom portion, and a first circumferential wall extending toward the valve seat along a peripheral portion of the first bottom portion. The valve seat includes a second bottom portion, and a second circumferential wall extending toward the valve body along a peripheral portion of the second bottom portion. One of the first circumferential wall and the second circumferential wall has an outside diameter smaller than an inside diameter of an open end of an other one of the first circumferential wall and the second circumferential wall. The valve body is movable between a position in which the first circumferential wall is spaced from the second circumferential wall, and a position in which at least a portion of the one of the circumferential walls is housed on an inner side of the other circumferential wall.

BRIEF DESCRIPTION OF THE DRAWINGS

FIG. 24 is a list of refrigerants for use as refrigerants applicable to a scroll compressor.

DETAILED DESCRIPTION OF EMBODIMENT(S)

First Embodiment

Figure 1:
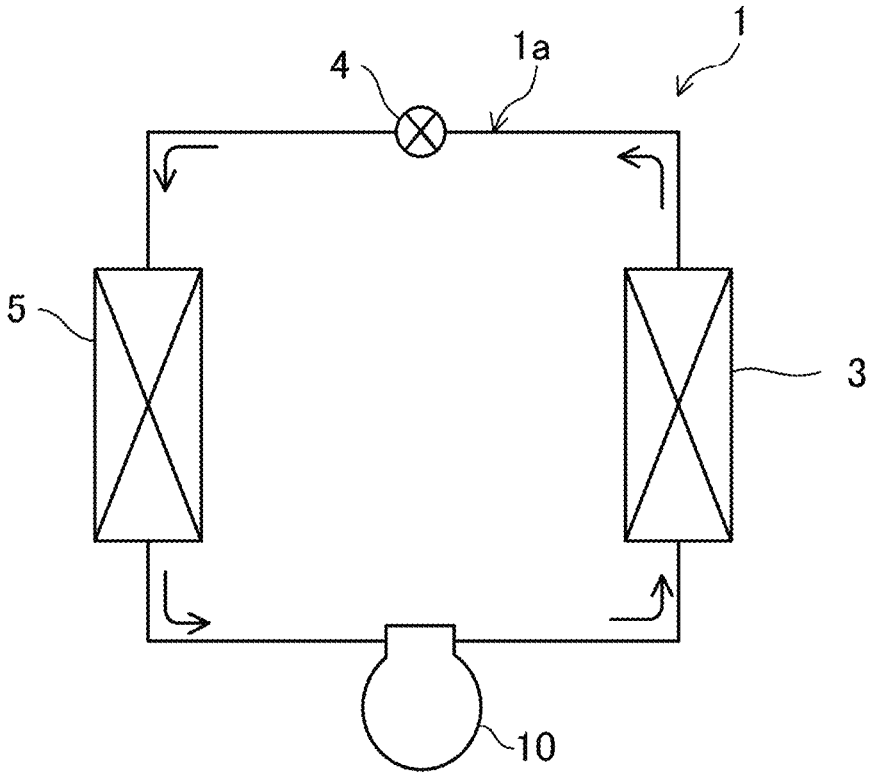
FIG. 1 is a refrigerant circuit diagram showing a configuration of a refrigeration apparatus according to a first embodiment.

As illustrated in FIG. 1, a scroll compressor (10) is provided in a refrigeration apparatus (1). The refrigeration apparatus (1) includes a refrigerant circuit (la) filled with a refrigerant. The refrigerant circuit (la) includes the scroll compressor (10), a radiator (3), a decompression mechanism (4), and an evaporator (5). The decompression mechanism (4) is, for example, an expansion valve. The refrigerant circuit (1*a*) performs a vapor compression refrigeration cycle.

In this embodiment, R513A or R1234yf is used as a refrigerant applicable to the scroll compressor (10). R513A is a refrigerant mixture consisting of HFC-134a and HFO-1234yf. R1234yf is a single-component refrigerant consisting of HFO-1234yf.

The refrigeration apparatus (1) is an air conditioner. The air conditioner may be any of a cooling-only apparatus, a heating-only apparatus, or an air conditioner switchable between cooling and heating. In this case, the air conditioner has a switching mechanism (e.g., a four-way switching valve) configured to switch the direction of circulation of the refrigerant. The refrigeration apparatus (1) may be a water heater, a chiller unit, or a cooling apparatus configured to cool air in an internal space. The cooling apparatus cools the air in an internal space of a refrigerator, a freezer, a container, or the like.

Figure 2:
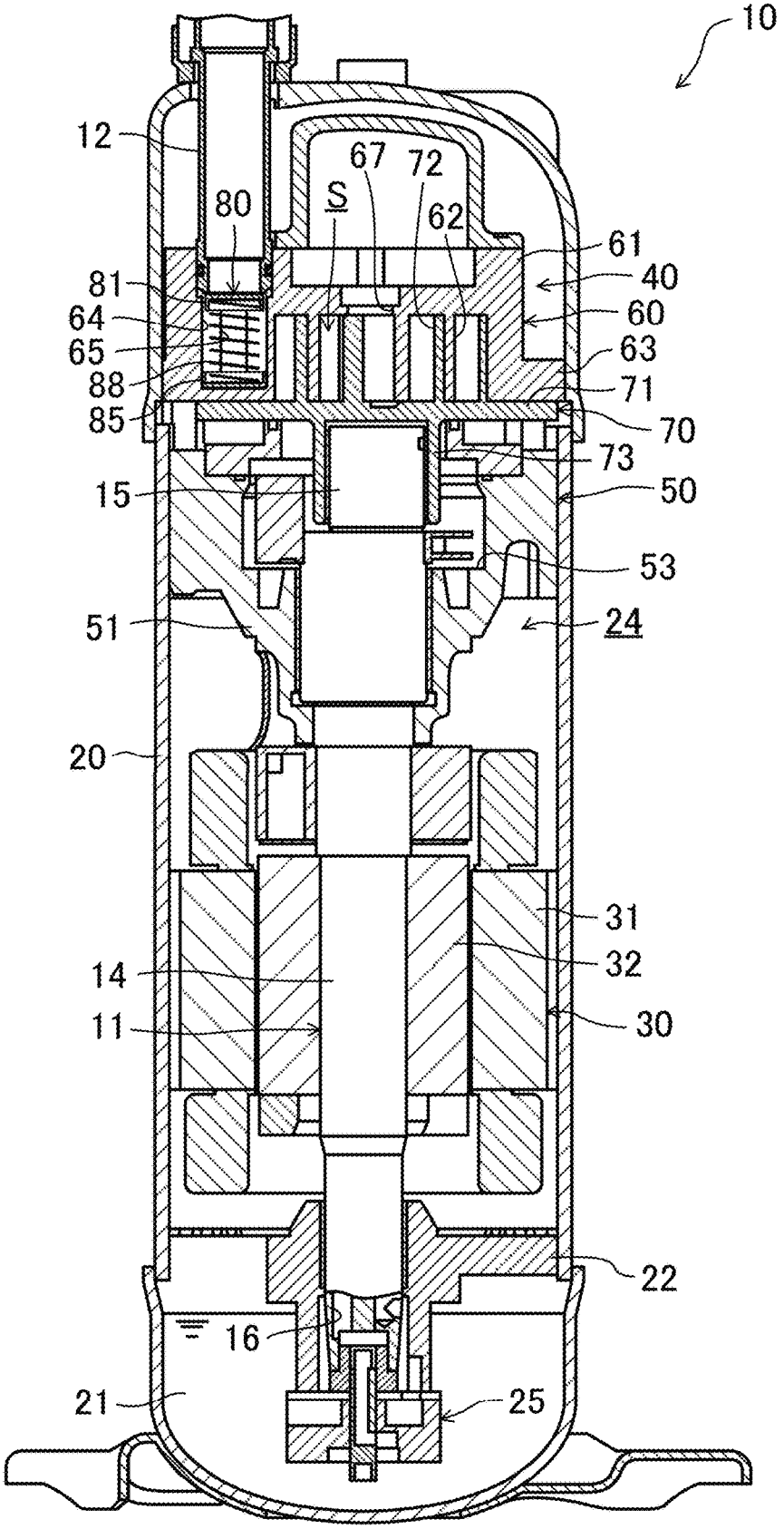
FIG. 2 is a vertical sectional view illustrating a configuration of a scroll compressor.

As illustrated in FIG. 2, the scroll compressor (10) includes a casing (20), an electric motor (30), and a compression mechanism (40). The casing (20) has a vertically oriented cylindrical shape, and is configured as a closed dome. The casing (20) houses the electric motor (30) and the compression mechanism (40).

The electric motor (30) includes a stator (31) and a rotor (32). The stator (31) is fixed to the inner circumferential surface of the casing (20). The rotor (32) is disposed inside the stator (31). A drive shaft (11) passes through the rotor (32). The rotor (32) is fixed to the drive shaft (11).

The casing (20) has, at its bottom, an oil reservoir (21). The oil reservoir (21) stores a lubricant. A suction pipe (12) is connected to an upper portion of the casing (20). A discharge pipe (not shown) is connected to a barrel of the casing (20).

A housing (50) is fixed to the casing (20). The housing (50) is fixed to the inside of the casing (20) by, for example, shrink fitting. The housing (50) is located above the electric motor (30). The compression mechanism (40) is located above the housing (50).

The housing (50) has a recess (53). The recess (53) is a recessed portion of the upper surface of the housing (50). An upper bearing (51) is located below the recess (53).

The drive shaft (11) extends vertically along the center axis of the casing (20). The drive shaft (11) has a main shaft portion (14) and an eccentric portion (15).

The eccentric portion (15) is provided at an upper end of the main shaft portion (14). The main shaft portion (14) has a lower portion rotatably supported by a lower bearing (22). The lower bearing (22) is fixed to the inner circumferential surface of the casing (20). The lower bearing (22) is provided with a positive-displacement pump (25), for example. The main shaft portion (14) has an upper portion passing through the housing (50) and rotatably supported by the upper bearing (51) of the housing (50).

The compression mechanism (40) includes a fixed scroll (60) and a movable scroll (70). The fixed scroll (60) is fixed to the upper surface of the housing (50). The movable scroll (70) is arranged between the fixed scroll (60) and the housing (50).

The fixed scroll (60) includes a fixed end plate (61), a fixed wrap (62), and an outer circumferential wall (63). The fixed wrap (62) is spiral. The fixed wrap (62) is formed on the lower surface of the fixed end plate (61). The outer circumferential wall (63) surrounds the outer periphery of the fixed wrap (62). The end surface of the fixed wrap (62) and the end surface of the outer circumferential wall (63) are substantially flush with each other. The fixed scroll (60) is fixed to the housing (50).

The movable scroll (70) includes a movable end plate (71), a movable wrap (72), and a boss (73). The movable wrap (72) is spiral. The movable wrap (72) is formed on the upper surface of the movable end plate (71).

The boss (73) is formed on a central portion of the lower surface of the movable end plate (71). The eccentric portion (15) of the drive shaft (11) is inserted into the boss (73), whereby the boss (73) is connected to the drive shaft (11).

An Oldham coupling (not shown) is provided at an upper portion of the housing (50). The Oldham coupling blocks the rotation of the movable scroll (70) on its axis.

The compression mechanism (40) has a fluid chamber (S) into which the refrigerant flows. The fluid chamber (S) is formed between the fixed scroll (60) and the movable scroll (70). The movable scroll (70) is placed so that the movable wrap (72) meshes with the fixed wrap (62) of the fixed scroll (60). Here, the lower surface of the outer circumferential wall (63) of the fixed scroll (60) serves as a facing surface that faces the movable scroll (70). On the other hand, the upper surface of the movable end plate (71) of the movable scroll (70) serves as a facing surface that faces the fixed scroll (60).

The fixed end plate (61) of the fixed scroll (60) has, at its center, an outlet (67). The high-pressure gas refrigerant discharged from the outlet (67) flows out into a lower space (24) via a passage (not shown) formed in the housing (50).

The outer circumferential wall (63) of the fixed end plate (61) has a suction passage (64). The suction passage (64) extends vertically near the winding end of the fixed wrap (62). The upper end of the suction passage (64) is open to the upper surface of the fixed end plate (61). The lower end of the suction passage (64) is closed by a lower end portion of the fixed end plate (61). A lower end portion of the suction pipe (12) is connected to an upper end portion of the suction passage (64).

A sidewall of the fixed end plate (61) has an inlet (65). The suction passage (64) communicates with the fluid chamber (S) via the inlet (65) (see FIG. 7). The refrigerant sucked from the suction pipe (12) is guided into the fluid chamber (S) via the suction passage (64) and the inlet (65).

A suction check valve (80) is arranged in the suction passage (64). The suction check valve (80) closes the open end of the suction pipe (12) during a stop of the operation of the scroll compressor (10), thereby preventing the fluid in the fluid chamber (S) from flowing back toward the suction pipe (12). Details of the suction check valve (80) will be described later.

An oil supply passage (16) is formed inside the drive shaft (11). The oil supply passage (16) extends vertically from the lower end to the upper end of the drive shaft (11). The pump (25) is connected to the lower end of the drive shaft (11). A lower end portion of the pump (25) is immersed in the oil reservoir (21). The pump (25) sucks up the lubricant from the oil reservoir (21) as the drive shaft (11) rotates, and transfers the lubricant to the oil supply passage (16). The oil supply passage (16) supplies the lubricant in the oil reservoir (21) to the sliding surfaces between the lower bearing (22) and the drive shaft (11) and the sliding surfaces between the upper bearing (51) and the drive shaft (11), and to the sliding surfaces between the boss (73) and the drive shaft (11). The oil supply passage (16) is open to the upper end surface of the drive shaft (11) and supplies the lubricant to above the drive shaft (11).

The recess (53) of the housing (50) communicates with the oil supply passage (16) of the drive shaft (11) via the inside of the boss (73) of the movable scroll (70). The high-pressure lubricant is supplied to the recess (53), so that a high pressure equivalent to the discharge pressure of the compression mechanism (40) acts on the recess (53). The movable scroll (70) is pressed onto the fixed scroll (60) by the high pressure that acts on the recess (53).

Configuration of Suction Check Valve

Figure 3:
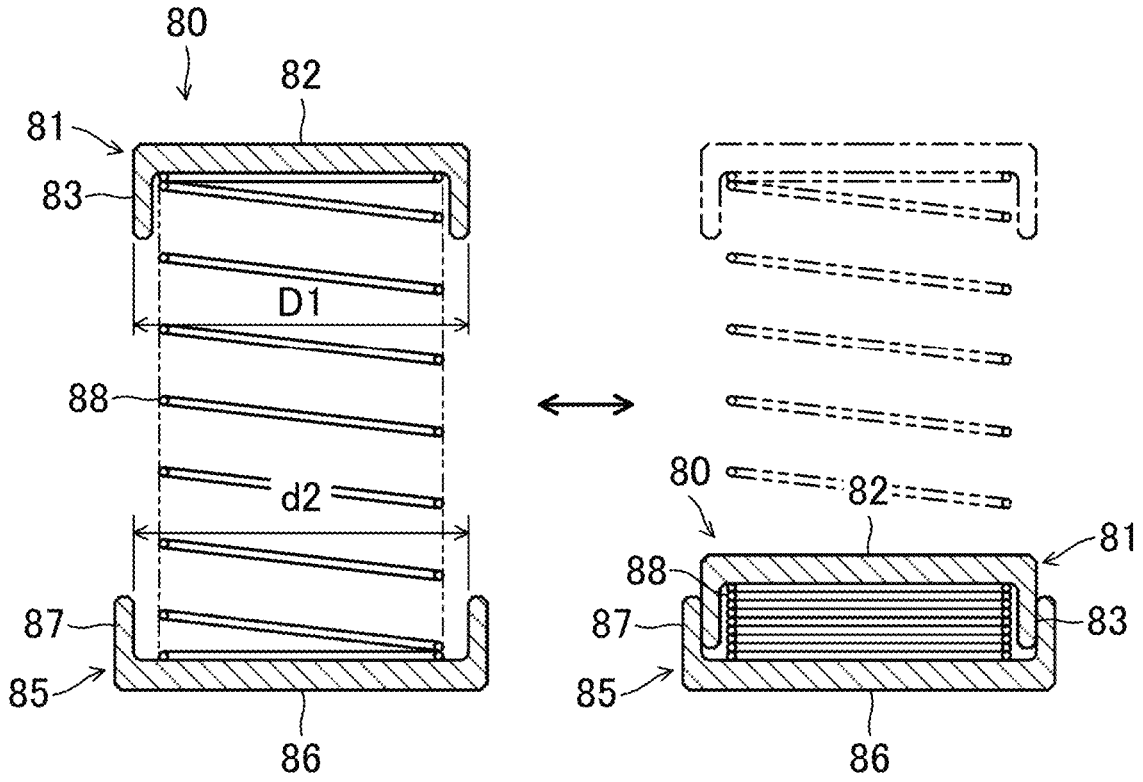
FIG. 3 is a cross-sectional side view illustrating a configuration of a suction check valve.

As illustrated in FIG. 3, the suction check valve (80) includes a valve body (81), a valve seat (85), and a compression spring (88). The valve body (81) closes the open end of the suction pipe (12) in a manner that allows opening and closing of the open end. The valve seat (85) faces, and is vertically spaced apart from, the valve body (81). The compression spring (88) is arranged between the valve body (81) and the valve seat (85) and biases the valve body (81) toward the open end of the suction pipe (12).

The valve body (81) includes a first bottom portion (82) and a first circumferential wall (83). The first bottom portion (82) is in the shape of a disk. The first circumferential wall (83) stands toward the valve seat (85) along the peripheral portion of the first bottom portion (82).

The valve seat (85) includes a second bottom portion (86) and a second circumferential wall (87). The second bottom portion (86) is in the shape of a disk. The second circumferential wall (87) stands toward the valve body (81) along the peripheral portion of the second bottom portion (86).

The outside diameter D1 of the first circumferential wall (83) and the inside diameter d2 of the open end of the second circumferential wall (87) are set to satisfy the condition D1<d2. Thus, when the valve body (81) is moved toward the valve seat (85), a portion of the first circumferential wall (83) of the valve body (81) is housed on the inner side of the second circumferential wall (87) of the valve seat (85).

Figure 4:
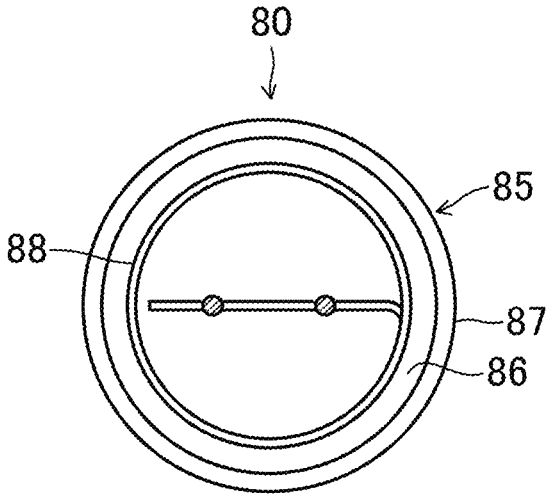
FIG. 4 is a plan view illustrating a state in which a valve seat and a compression spring are joined together.

Here, the inside diameter of the second circumferential wall (87) of the valve seat (85) is set to a dimension that allows the accommodation of the first circumferential wall (83) of the valve body (81), and is therefore larger than the outside diameter of the compression spring (88) by the dimension. Thus, to restrict the movement of the compression spring (88) in the radial direction, the compression spring (88) is welded and joined to the second bottom portion (86) of the valve seat (85) (see the hatched portions in FIG. 4).

Figure 5:
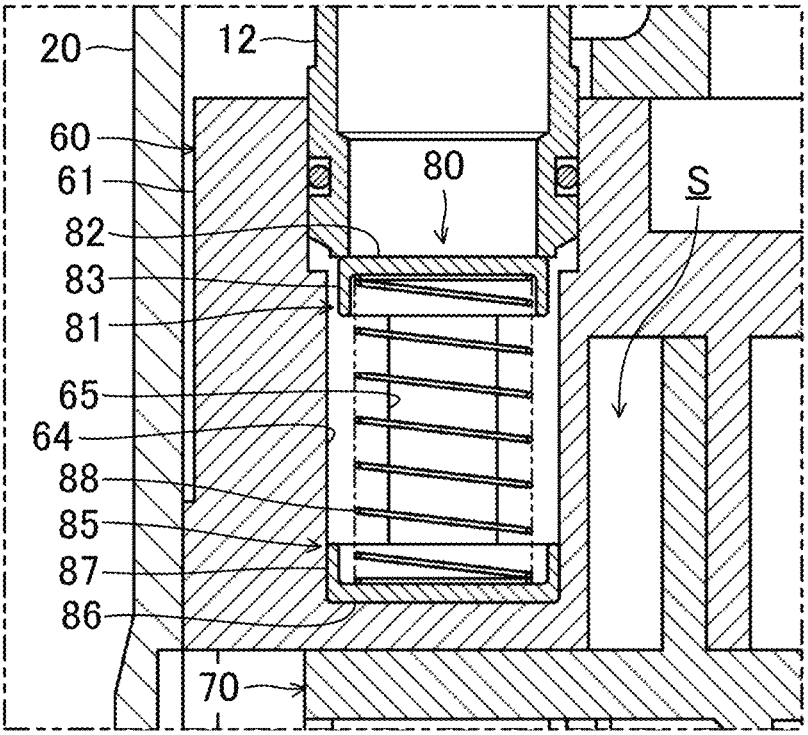
FIG. 5 is an enlarged view of a suction passage and its surrounding area in a state in which the suction check valve is closed.

As illustrated in FIG. 5, the first bottom portion (82) is formed into a size that allows closing of the open end of the suction pipe (12), i.e., a diameter larger than the inside diameter of the open end of the suction pipe (12). The first bottom portion (82) is formed into a size that allows reciprocation in the suction passage (64) in the direction of extension of the suction passage (64) (in the vertical direction in FIG. 5), i.e., a diameter smaller than the inside diameter of the suction passage (64).

The outside diameter of the first circumferential wall (83) is formed into a dimension that allows reciprocation in the suction passage (64) in the direction of extension of the suction passage (64) (in the vertical direction in FIG. 5) together with the first bottom portion (82), i.e., smaller than the inside diameter of the suction passage (64). The first circumferential wall (83) extends along the inner wall of the suction passage (64).

Since the first circumferential wall (83) extends along the inner wall of the suction passage (64) as described above, the first bottom portion (82) is less likely to incline during the reciprocation in the suction passage (64). The inside diameter of the first circumferential wall (83) is formed into a dimension that allows accommodation of one end portion of the compression spring (88), i.e., larger than the outside diameter of the compression spring (88).

The second bottom portion (86) is formed to have a diameter smaller than the inside diameter of the suction passage (64). The second bottom portion (86) is provided along the closed end surface (the lower end surface in FIG. 5) of the suction passage (64). The outside diameter of the second circumferential wall (87) is smaller than the inside diameter of the suction passage (64) and extends along the inner wall of the suction passage (64).

The compression spring (88) in a contracted state is provided between the valve body (81) and the valve seat (85) to always apply, to the valve body (81), a biasing force for pressing the valve body (81) against the open end of the suction pipe (12). In other words, the compression spring (88) is configured to apply a biasing force to the valve body (81) even at a full-close position where the valve body (81) is pressed against the open end of the suction pipe (12).

The opening degree of the valve body (81) refers to the position of the valve body (81) relative to the open end of the suction pipe (12): the opening degree is 0% at the full-close position where the valve body (81) closes the open end of the suction pipe (12); and the opening degree is 100% at a full-open position where the first circumferential wall (83) of the valve body (81) is housed on the inner side of the second circumferential wall (87) of the valve seat (85).

As illustrated in FIG. 5, the valve body (81) closes the open end of the suction pipe (12) during a stop of the scroll compressor (10), thereby preventing the fluid in the fluid chamber (S) from flowing back toward the suction pipe (12).

Figure 6:
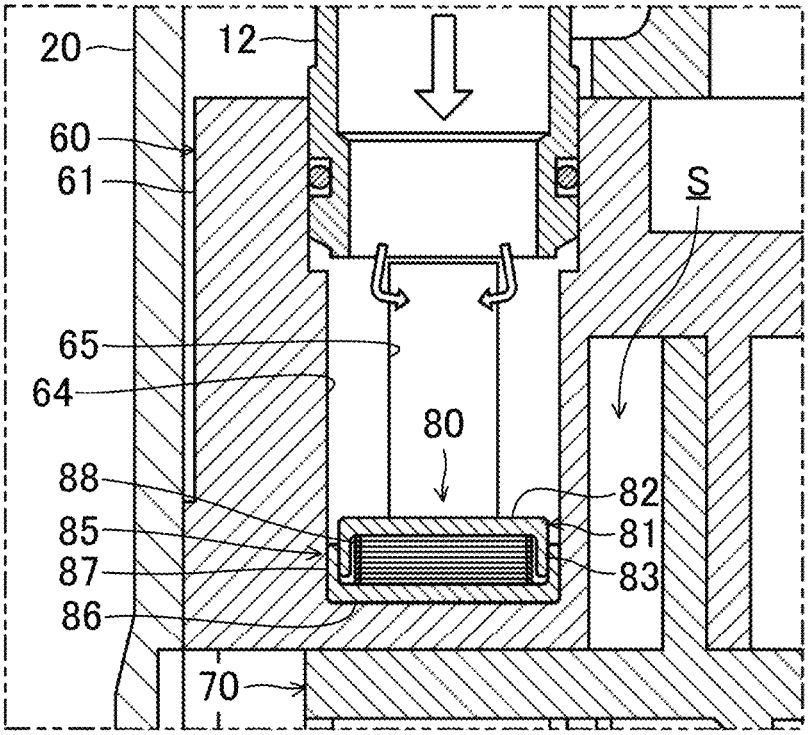
FIG. 6 is an enlarged view of the suction passage and its surrounding area in a state in which the suction check valve is open.
Figure 7:
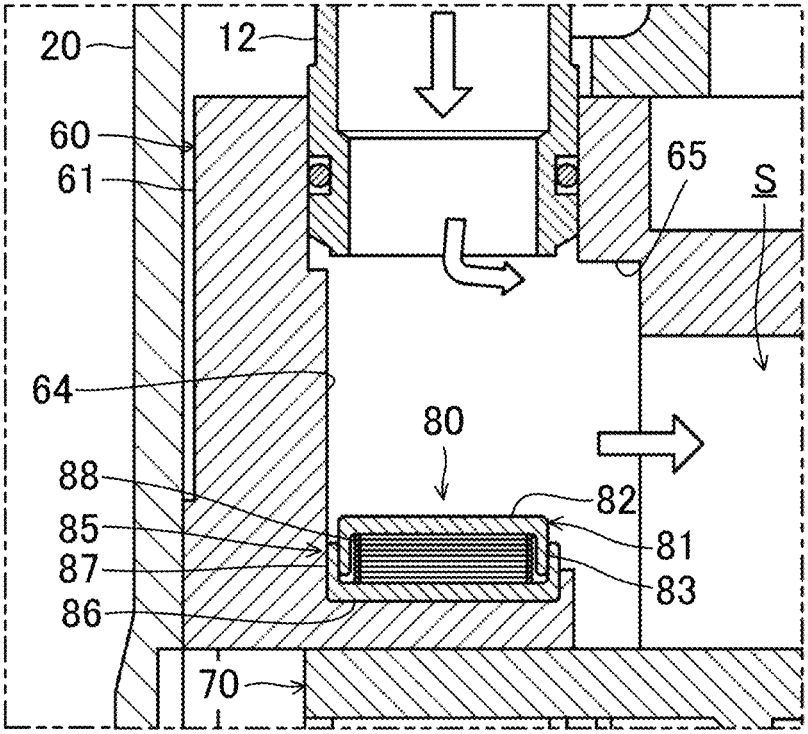
FIG. 7 is an enlarged view of the suction passage and its surrounding area as viewed from a different angle from that in FIG. 6.

In contrast, as illustrated in FIGS. 6 and 7, during operation of the scroll compressor (10), the upper surface of the valve body (81) is pressed by the refrigerant sucked from the suction pipe (12). Accordingly, the valve body (81) closing the open end of the suction pipe (12) moves away from the open end against the biasing force of the compression spring (88), thereby opening the suction pipe (12). As a result, the suction pipe (12) and the suction passage (64) communicate with each other, and the refrigerant in the suction pipe (12) is sucked into the fluid chamber (S) via the suction passage (64).

At this time, a portion of the first circumferential wall (83) of the valve body (81) is housed on the inner side of the second circumferential wall (87) of the valve seat (85), thereby making it possible to increase the passage area of the suction passage (64) by the portion housed. It is therefore possible to reduce suction pressure loss during operation of the scroll compressor (10) and improve the volume efficiency of the compressor.

Operation

A basic operation of the scroll compressor (10) will be described. In FIG. 2, when the electric motor (30) is activated, the drive shaft (11) to which the rotor (32) is fixed is driven to rotate. Since the rotation of the movable scroll (70) on its own axis is blocked by the Oldham coupling (not shown), the movable scroll (70) makes an orbiting motion about the axis of the drive shaft (11).

The orbiting motion of the movable scroll (70) causes the refrigerant to be compressed in the fluid chamber (S). The high-pressure gas refrigerant compressed in the fluid chamber (S) is discharged from the outlet (67), and flows out into the lower space (24) via the passage (not shown) formed in the housing (50). The high-pressure gas refrigerant in the lower space (24) is discharged outside the casing (20) via the discharge pipe (13).

The rotation of the drive shaft (11) causes the high-pressure lubricant in the oil reservoir (21) to be sucked up by the pump (25). The lubricant sucked up flows upward through the oil supply passage (16) of the drive shaft (11) and flows out from the opening at the upper end of the eccentric portion (15) of the drive shaft (11) into the inside of the boss (73) of the movable scroll (70).

The lubricant supplied to the boss (73) flows out into the recess (53) of the housing (50) through the gap between the eccentric portion (15) of the drive shaft (11) and the boss (73). Accordingly, the recess (53) of the housing (50) has a high pressure equivalent to the discharge pressure of the compression mechanism (40). The high pressure of the recess (53) presses the movable scroll (70) onto the fixed scroll (60).

Advantages of First Embodiment

According to a feature of the first embodiment, one of the first circumferential wall (83) of the valve body (81) or the second circumferential wall (87) of the valve seat (85) is set to have an outside diameter smaller than the inside diameter of the open end of the other circumferential wall, thereby making it possible to house one of the circumferential walls on the inner side of the other circumferential wall.

This allows an increase in the passage area of the suction passage (64) by the portion of the circumferential wall of the valve body (81) or the valve seat (85) which has been housed, thereby making it possible to reduce suction pressure loss during operation of the scroll compressor (10) and improve the volume efficiency of the compressor.

According to a feature of the first embodiment, the first circumferential wall (83) of the valve body (81) can be housed on the inner side of the second circumferential wall (87) of the valve seat (85), thereby making it possible to keep the passage area of the suction passage (64) from decreasing and reduce suction pressure loss during operation of the scroll compressor (10).

According to a feature of the first embodiment, the volume efficiency of the compressor can be improved even if R513A, which is an intermediate/low pressure refrigerant, is used.

Specifically, in a scroll compressor (10) for low-temperature applications using R513A, which is an intermediate/low pressure refrigerant, the absolute value of the suction pressure is small; therefore, the proportion of the influence of the pressure loss in the suction passage (64) is large.

This embodiment allows an increase in the passage area of the suction passage (64) by the portion of the circumferential wall of the valve body (81) or the valve seat (85) which has been housed, thereby making it possible to reduce suction pressure loss during operation of the scroll compressor (10) and improve the volume efficiency of the compressor.

According to a feature of the first embodiment, the volume efficiency of the compressor can be improved even if R1234yf, which is an intermediate/low pressure refrigerant, is used.

First Variation of First Embodiment

In the following description, the same reference characters designate the same components as those of the first embodiment, and the description is focused only on the difference.

Figure 8:
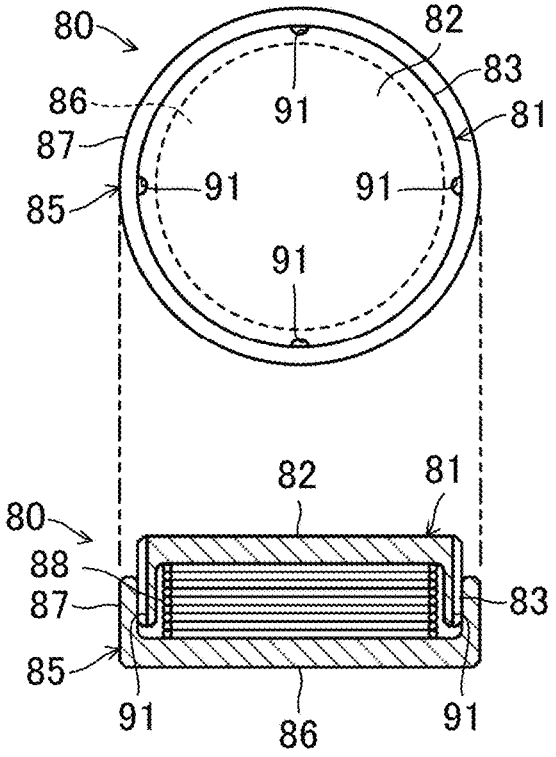
FIG. 8 illustrates a plan view and a cross-sectional side view of a configuration of a suction check valve according to a first variation of the first embodiment.

As illustrated in FIG. 8, the outside diameter of the first circumferential wall (83) of the valve body (81) is smaller than the inside diameter of the open end of the second circumferential wall (87) of the valve seat (85). Thus, when the valve body (81) is moved toward the valve seat (85), a portion of the first circumferential wall (83) of the valve body (81) is housed on the inner side of the second circumferential wall (87) of the valve seat (85).

The outer circumferential surface of the first circumferential wall (83) has a plurality of outer grooves (91). The outer grooves (91) extend along the direction of expansion and contraction of the compression spring (88). In the example illustrated in FIG. 8, four outer grooves (91) are arranged so as to be spaced apart from one another in the circumferential direction. The number of the outer grooves (91) is an example and is not limited thereto.

Advantages of First Variation of First Embodiment

According to a feature of the first variation of the first embodiment, the area of contact between the first circumferential wall (83) and the second circumferential wall (87) is reduced, so that it is possible to reduce the chances of the valve body (81) not returning toward the suction pipe (12) due to the viscosity of the lubricant between the first circumferential wall (83) and the second circumferential wall (87) during a stop of the scroll compressor (10).

Second Variation of First Embodiment

Figure 9:
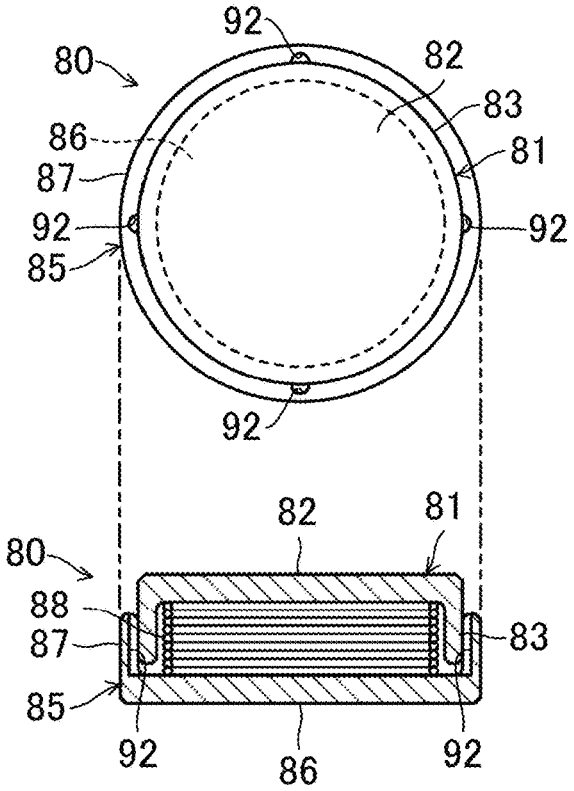
FIG. 9 illustrates a plan view and a cross-sectional side view of a configuration of a suction check valve according to a second variation of the first embodiment.

As illustrated in FIG. 9, the outside diameter of the first circumferential wall (83) of the valve body (81) is smaller than the inside diameter of the open end of the second circumferential wall (87) of the valve seat (85). Thus, when the valve body (81) is moved toward the valve seat (85), a portion of the first circumferential wall (83) of the valve body (81) is housed on the inner side of the second circumferential wall (87) of the valve seat (85).

The inner circumferential surface of the second circumferential wall (87) has a plurality of inner grooves (92). The inner grooves (92) extend along the direction of expansion and contraction of the compression spring (88). In the example illustrated in FIG. 9, four inner grooves (92) are arranged so as to spaced apart from one another in the circumferential direction. The number of the inner grooves (92) is an example and is not limited thereto.

Advantages of Second Variation of First Embodiment

According to a feature of the second variation of the first embodiment, the area of contact between the first circumferential wall (83) and the second circumferential wall (87) is reduced, so that it is possible to reduce the chances of the valve body (81) not returning toward the suction pipe (12) due to the viscosity of the lubricant between the first circumferential wall (83) and the second circumferential wall (87) during a stop of the scroll compressor (10).

Third Variation of First Embodiment

Figure 10:
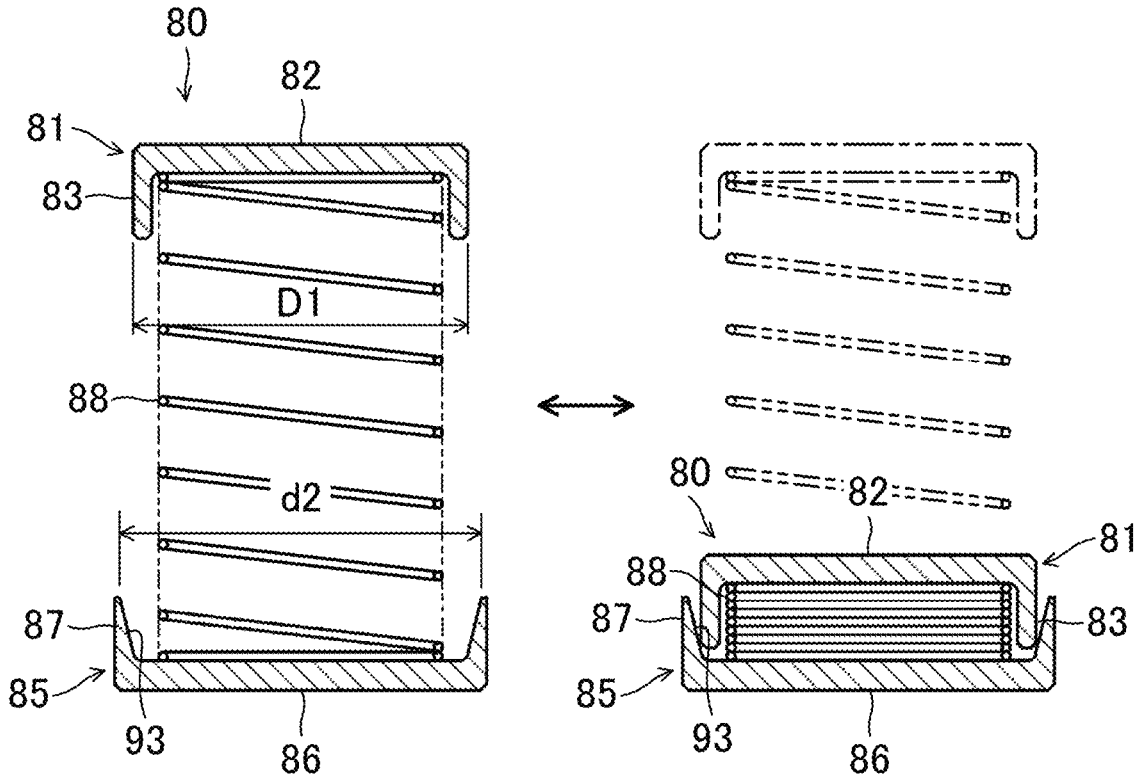
FIG. 10 illustrates cross-sectional side views of a configuration of a suction check valve according to a third variation of the first embodiment.

As illustrated in FIG. 10, the outside diameter of the first circumferential wall (83) of the valve body (81) is smaller than the inside diameter of the open end of the second circumferential wall (87) of the valve seat (85). Thus, when the valve body (81) is moved toward the valve seat (85), a portion of the first circumferential wall (83) of the valve body (81) is housed on the inner side of the second circumferential wall (87) of the valve seat (85).

A tapered portion (93) is formed on the inner circumferential surface of the second circumferential wall (87). The tapered portion (93) is inclined such that the inside diameter of the second circumferential wall (87) increases gradually toward the valve body (81). When the valve body (81) is moved toward the valve seat (85), only the outer edge of the lower end of the first circumferential wall (83) of the valve body (81) is brought into contact with the tapered portion (93) of the second circumferential wall (87) of the valve seat (85).

Advantages of Third Variation of First Embodiment

According to a feature of the third variation of the first embodiment, the area of contact between the first circumferential wall (83) and the second circumferential wall (87) is reduced, so that it is possible to reduce the chances of the valve body (81) not returning toward the suction pipe (12) due to the viscosity of the lubricant between the first circumferential wall (83) and the second circumferential wall (87) during a stop of the scroll compressor (10).

Fourth Variation of First Embodiment

Figure 11:
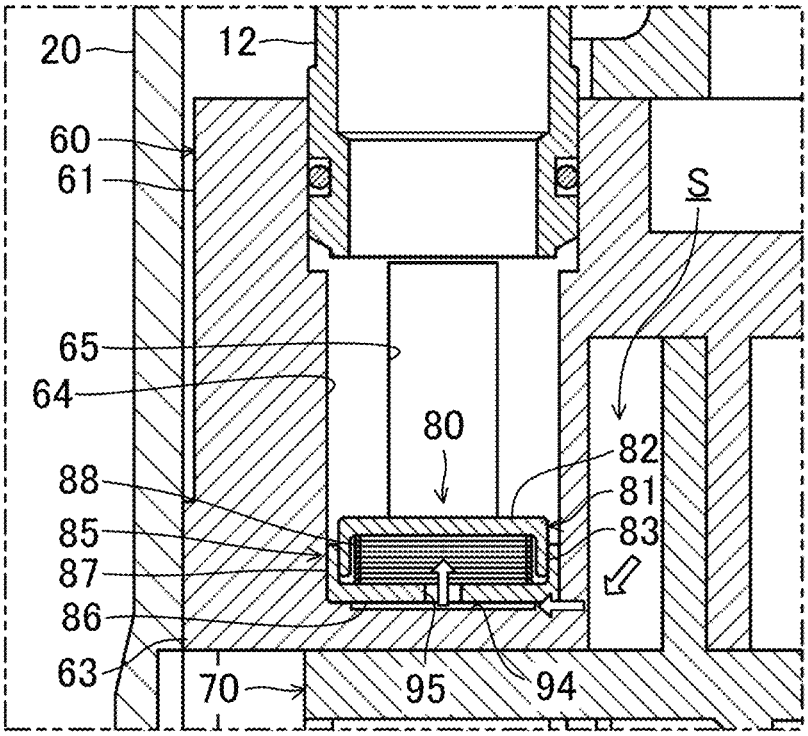
FIG. 11 is an enlarged view of a suction passage and its surrounding area in a state in which a suction check valve according to a fourth variation of the first embodiment is open.

As illustrated in FIG. 11, the outer circumferential wall (63) of the fixed end plate (61) has a connection passage (94). One end of the connection passage (94) is open to a mounting surface in the suction passage (64) on which the valve seat (85) is mounted. The other end of the connection passage (94) is open into the fluid chamber (S). Thus, the suction passage (64) and the fluid chamber (S) are connected together via the connection passage (94).

The second bottom portion (86) of the valve seat (85) has a communication hole (95). The communication hole (95) communicates with the connection passage (94) in a state in which the valve seat (85) is mounted on the mounting surface in the suction passage (64).

Here, during operation of the scroll compressor (10), the valve body (81) moves toward the valve seat (85) against the biasing force of the compression spring (88), and the first circumferential wall (83) is housed on the inner side of the second circumferential wall (87). Then, during a stop of the scroll compressor (10), the refrigerant pushing the valve body (81) is no longer sucked, and the valve body (81) is moved by the biasing force of the compression spring (88) to the position at which the valve body (81) closes the open end of the suction pipe (12). At this moment, the valve body (81) may sometimes not return toward the suction pipe (12) due to the viscosity of the lubricant between the first circumferential wall (83) and the second circumferential wall (87) during the stop of the scroll compressor (10)

However, in this variation, the refrigerant in the fluid chamber (S) flows between the valve body (81) and the valve seat (85) via the connection passage (94) and the communication hole (95) during the stop of the scroll compressor (10) (see the hollow arrows in FIG. 11).

Figure 12:
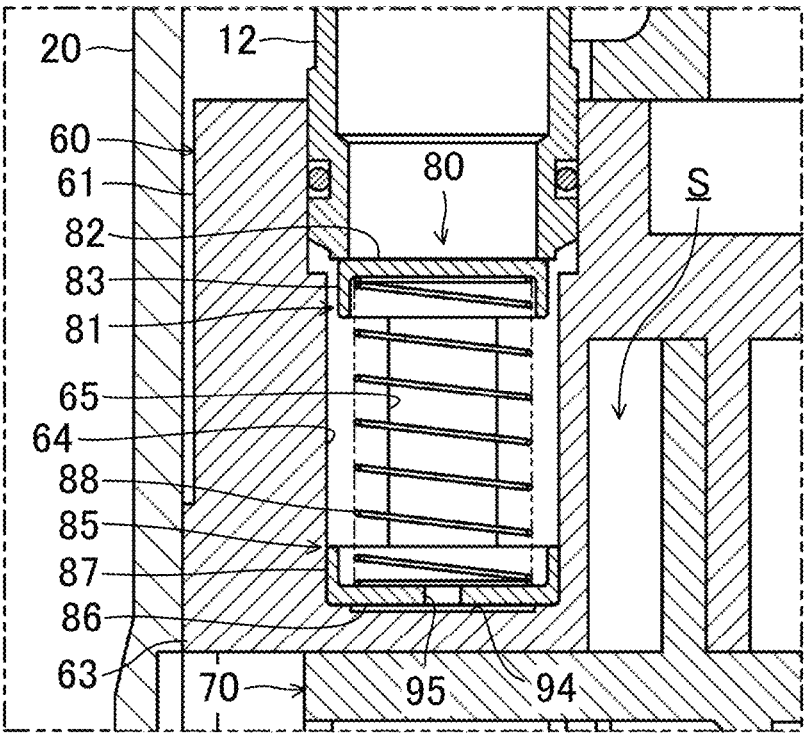
FIG. 12 is an enlarged view of the suction passage and its surrounding area in a state in which the suction check valve according to the fourth variation of the first embodiment is closed.

Thus, the valve body (81) is pushed up by the refrigerant that has flowed through the connection passage (94) and the communication hole (95). It is this possible to return the valve body (81) to the full-close position (see FIG. 12).

Advantages of Fourth Variation of First Embodiment

According to a feature of the fourth variation of the first embodiment, the refrigerant in the fluid chamber (S) flows between the valve body (81) and the valve seat (85) via the connection passage (94) and the communication hole (95) during a stop of the scroll compressor (10), which makes it possible to return the valve body (81) toward the suction pipe (12).

Fifth Variation of First Embodiment

Figure 13:
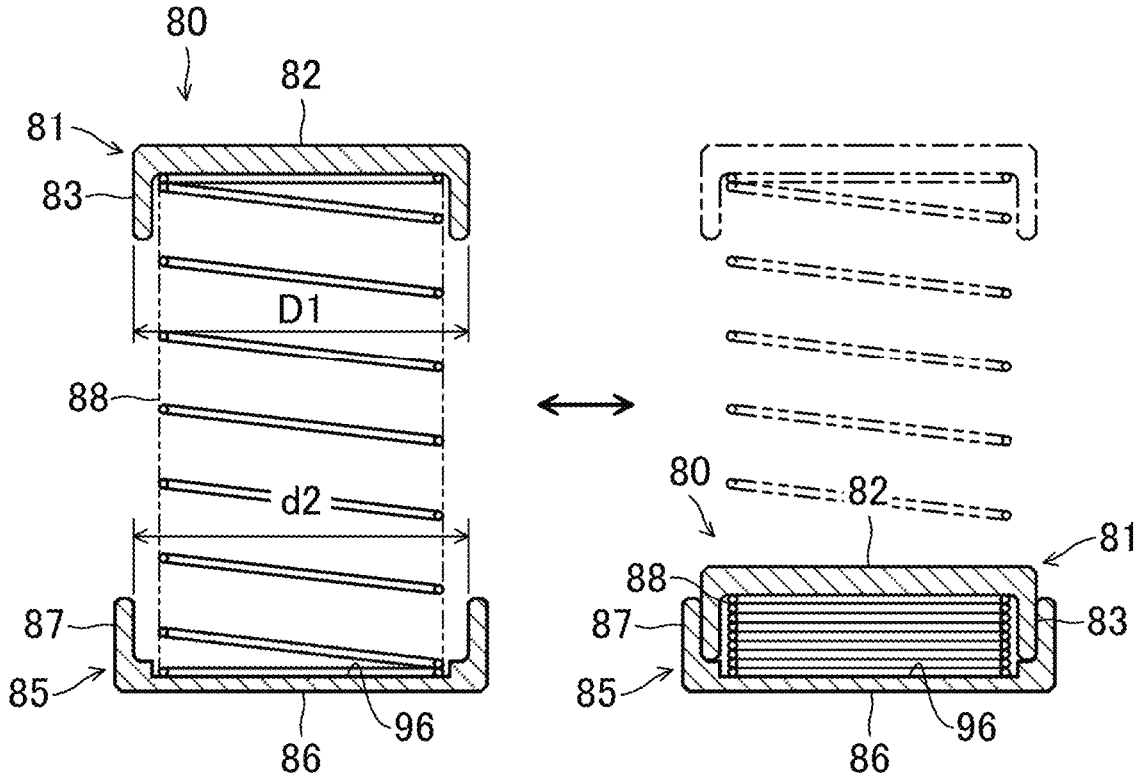
FIG. 13 illustrates cross-sectional side views of a configuration of a suction check valve according to a fifth variation of the first embodiment.

As illustrated in FIG. 13, a surface of the second bottom portion (86) of the valve seat (85) near the valve body (81) has a spring housing portion (96). The spring housing portion (96) is a recessed portion of the upper surface of the second bottom portion (86). The inside diameter of the spring housing portion (96) is larger than the outside diameter of the compression spring (88). The spring housing portion (96) houses a lower end portion of the compression spring (88).

Although not shown, the compression spring (88) is welded and joined to the second bottom portion (86) in the spring housing portion (96).

Advantages of Fifth Variation of First Embodiment

According to a feature of the fifth variation of the first embodiment, it is possible to restrict the movement of the compression spring (88) in the radial direction.

Sixth Variation of First Embodiment

Figure 14:
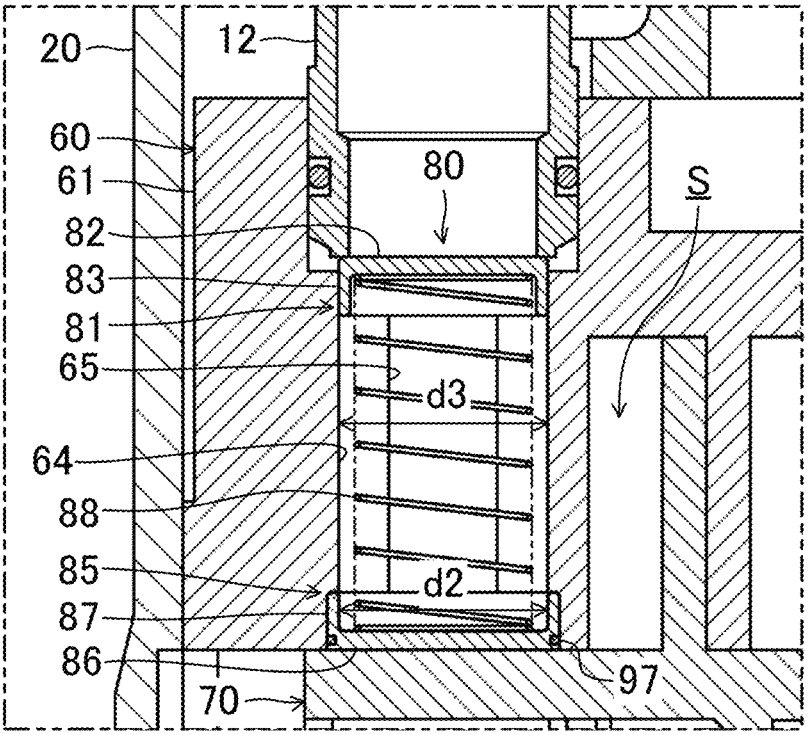
FIG. 14 is an enlarged view of a suction passage and its surrounding area in which a suction check valve according to a sixth variation of the first embodiment is closed.
Figure 15:
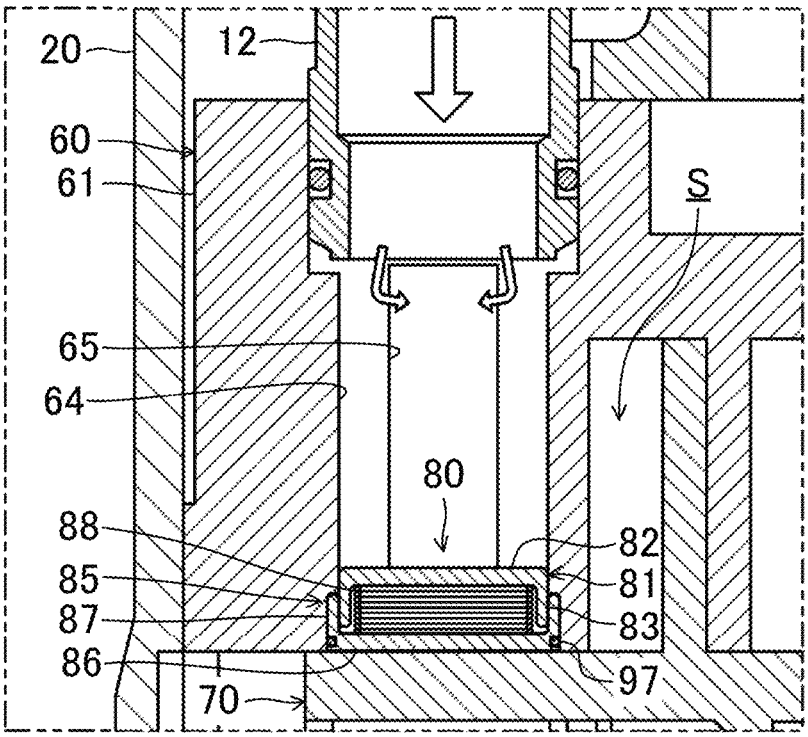
FIG. 15 is an enlarged view of the suction passage and its surrounding area in which the suction check valve according to the sixth variation of the first embodiment is open.

As illustrated in FIG. 14, the suction passage (64) extends along the axial direction of the suction pipe (12) and is open to a surface of the fixed scroll (60) that faces the movable scroll (70). The outer circumferential surface of the valve seat (85) has a recess around its entire perimeter. A seal ring (97) is fitted into the recess. The valve seat (85) is fitted into the lower opening of the suction passage (64) to close the opening. The valve seat (85) may be press-fitted into the lower opening of the suction passage (64) without providing the seal ring (97).

Here, the inside diameter d3 of the suction passage (64) and the inside diameter d2 of the open end of the second circumferential wall (87) are set to satisfy the condition $d3 \leq d2$.

Thus, during operation of the scroll compressor (10), the valve body (81) moves along the inner circumferential surface of the suction passage (64) when the valve body (81) moves toward the valve seat (85) against the biasing force of the compression spring (88). The valve body (81) is therefore less likely to incline.

The outside diameter of the first circumferential wall (83) of the valve body (81) is smaller than the inside diameter of the open end of the second circumferential wall (87) of the valve seat (85). Thus, when the valve body (81) is moved toward the valve seat (85), a portion of the first circumferential wall (83) of the valve body (81) is housed on the inner side of the second circumferential wall (87) of the valve seat (85).

Advantages of Sixth Variation of First Embodiment

According to a feature of the sixth variation of the first embodiment, it is possible to restrict the movement of the valve seat (85) in the radial direction in the suction passage (64).

Even if the first circumferential wall (83) of the valve body (81) has an outside diameter substantially equal to the inside diameter of the suction passage (64), the first circumferential wall (83) can be housed on the inner side of the second circumferential wall (87). It is thus possible to move the valve body (81) smoothly along the suction passage (64).

Second Embodiment

A second embodiment will be described.

Figure 16:
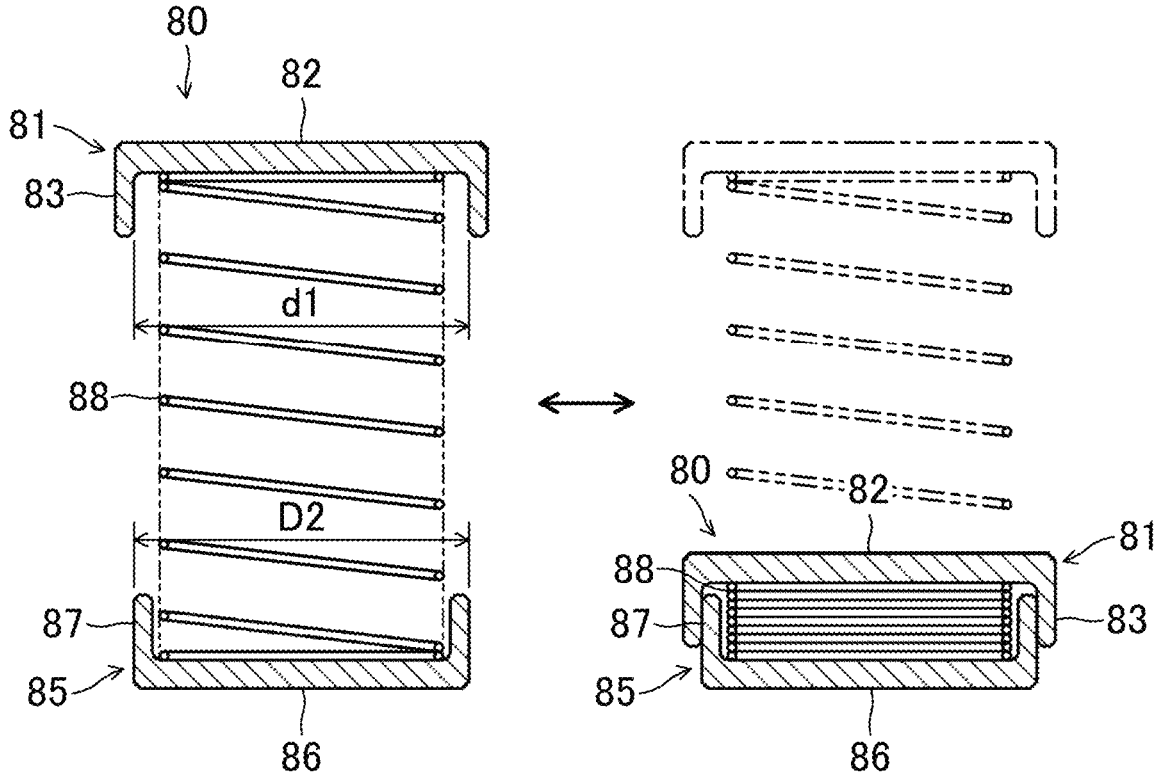
FIG. 16 illustrates cross-sectional side views of a configuration of a suction check valve according to a second embodiment.

As illustrated in FIG. 16, a suction check valve (80) includes a valve body (81), a valve seat (85), and a compression spring (88). The valve body (81) closes the open end of the suction pipe (12) in a manner that allows opening and closing of the open end. The valve seat (85) faces, and is vertically spaced apart from, the valve body (81). The compression spring (88) is arranged between the valve body (81) and the valve seat (85) and biases the valve body (81) toward the open end of the suction pipe (12).

The valve body (81) includes a first bottom portion (82) and a first circumferential wall (83). The first bottom portion (82) is in the shape of a disk. The first circumferential wall (83) stands toward the valve seat (85) along the peripheral portion of the first bottom portion (82).

The valve seat (85) includes a second bottom portion (86) and a second circumferential wall (87). The second bottom portion (86) is in the shape of a disk. The second circumferential wall (87) stands toward the valve body (81) along the peripheral portion of the second bottom portion (86).

The inside diameter d1 of the open end of the first circumferential wall (83) and the outside diameter D2 of the second circumferential wall (87) are set to satisfy the condition D2<d1. Thus, when the valve body (81) is moved toward the valve seat (85), a portion of the second circumferential wall (87) of the valve seat (85) is housed on the inner side of the first circumferential wall (83) of the valve body (81).

Here, the inside diameter of the first circumferential wall (83) of the valve body (81) is set to a dimension that allows the accommodation of the second circumferential wall (87) of the valve seat (85), and is therefore larger than the outside diameter of the compression spring (88) by the dimension. Thus, to restrict the movement of the compression spring (88) in the radial direction, the compression spring (88) is welded and joined to the first bottom portion (82) of the valve body (81).

Figure 17:
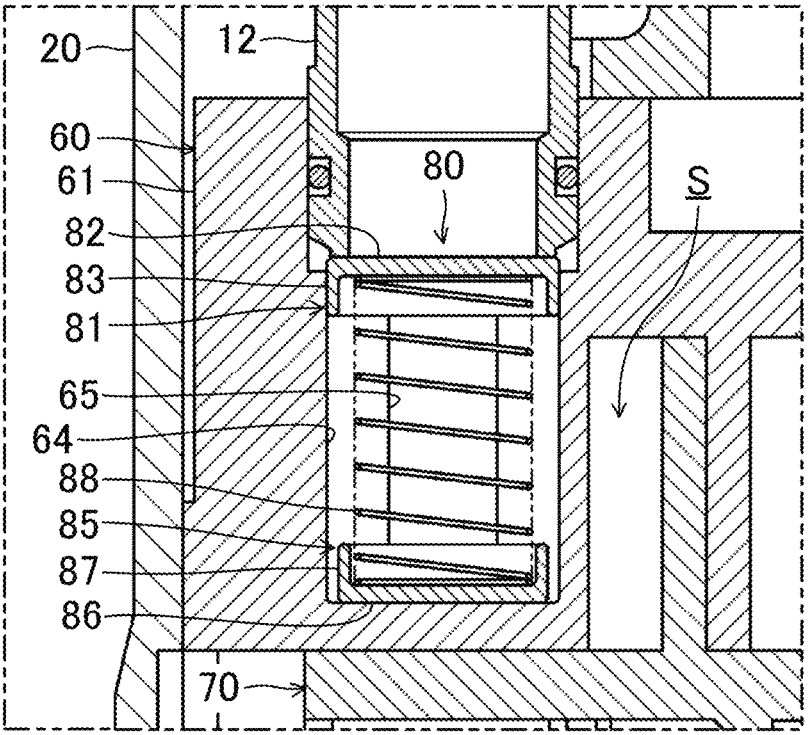
FIG. 17 is an enlarged view of a suction passage and its surrounding area in a state in which the suction check valve is closed.

As illustrated in FIG. 17, the valve body (81) closes the open end of the suction pipe (12) during a stop of the scroll compressor (10), thereby preventing the fluid in the fluid chamber (S) from flowing back toward the suction pipe (12).

Figure 18:
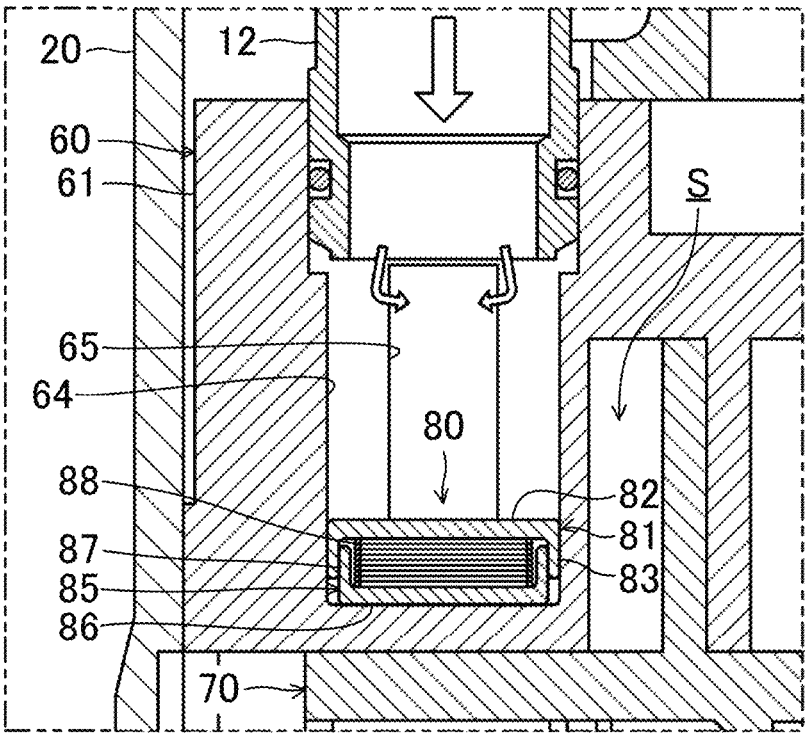
FIG. 18 is an enlarged view of the suction passage and its surrounding area in a state in which the suction check valve is open.

In contrast, as illustrated in FIG. 18, during operation of the scroll compressor (10), the upper surface of the valve body (81) is pressed by the refrigerant sucked from the suction pipe (12). Accordingly, the valve body (81) closing the open end of the suction pipe (12) moves away from the open end against the biasing force of the compression spring (88), thereby opening the suction pipe (12). As a result, the suction pipe (12) and the suction passage (64) communicate with each other, and the refrigerant in the suction pipe (12) is sucked into the fluid chamber (S) via the suction passage (64).

At this time, a portion of the second circumferential wall (87) of the valve seat (85) is housed on the inner side of the first circumferential wall (83) of the valve body (81), thereby making it possible to increase the passage area of the suction passage (64) by the portion housed. It is therefore possible to reduce suction pressure loss during operation of the scroll compressor (10) and improve the volume efficiency of the compressor.

Advantages of Second Embodiment

According to a feature of the second embodiment, the second circumferential wall (87) of the valve seat (85) can be housed on the inner side of the first circumferential wall (83) of the valve body (81), thereby making it possible to keep the passage area of the suction passage (64) from decreasing and reduce suction pressure loss during operation of the scroll compressor (10).

First Variation of Second Embodiment

In the following description, the same reference characters designate the same components as those of the second embodiment, and the description is focused only on the difference.

Figure 19:
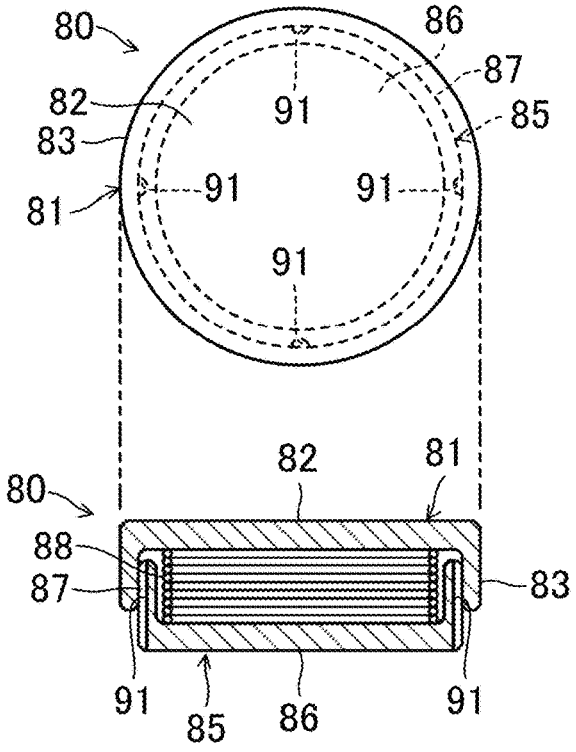
FIG. 19 illustrates a plan view and a cross-sectional side view of a configuration of a suction check valve according to a first variation of the second embodiment.

As illustrated in FIG. 19, the outside diameter of the second circumferential wall (87) of the valve seat (85) is smaller than the inside diameter of the open end of the first circumferential wall (83) of the valve body (81). Thus, when the valve body (81) is moved toward the valve seat (85), a portion of the second circumferential wall (87) of the valve seat (85) is housed on the inner side of the first circumferential wall (83) of the valve body (81).

The outer circumferential surface of the second circumferential wall (87) has a plurality of outer grooves (91). The outer grooves (91) extend along the direction of expansion and contraction of the compression spring (88). In the example illustrated in FIG. 19, four outer grooves (91) are arranged so as to be spaced apart from one another in the circumferential direction. The number of the outer grooves (91) is an example and is not limited thereto.

Advantages of First Variation of Second Embodiment

According to a feature of the first variation of the second embodiment, the area of contact between the first circumferential wall (83) and the second circumferential wall (87) is reduced, so that it is possible to reduce the chances of the valve body (81) not returning toward the suction pipe (12) due to the viscosity of the lubricant between the first circumferential wall (83) and the second circumferential wall (87) during a stop of the scroll compressor (10).

Second Variation of Second Embodiment

Figure 20:
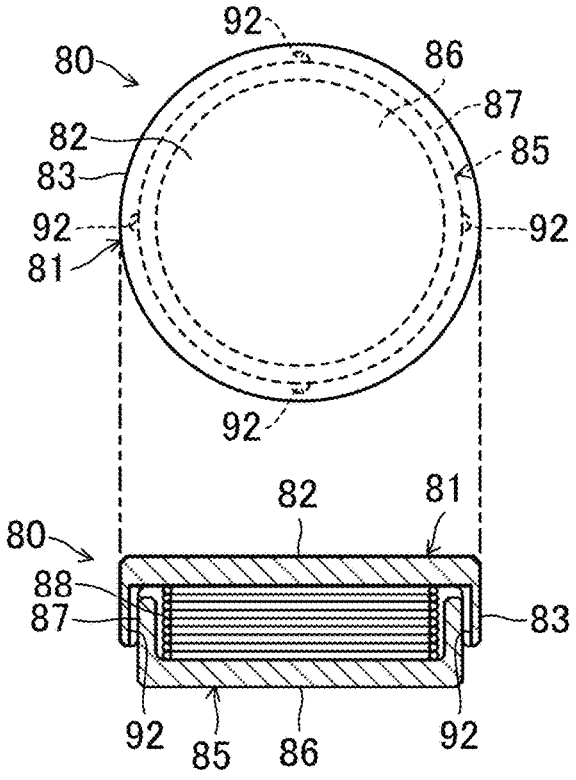
FIG. 20 illustrates a plan view and a cross-sectional side view illustrating a configuration of a suction check valve according to a second variation of the second embodiment.

As illustrated in FIG. 20, the outside diameter of the second circumferential wall (87) of the valve seat (85) is smaller than the inside diameter of the open end of the first circumferential wall (83) of the valve body (81). Thus, when the valve body (81) is moved toward the valve seat (85), a portion of the second circumferential wall (87) of the valve seat (85) is housed on the inner side of the first circumferential wall (83) of the valve body (81).

The inner circumferential surface of the first circumferential wall (83) has a plurality of inner grooves (92). The inner grooves (92) extend along the direction of expansion and contraction of the compression spring (88). In the example illustrated in FIG. 20, four inner grooves (92) are arranged so as to spaced apart from one another in the circumferential direction. The number of the inner grooves (92) is an example and is not limited thereto.

Advantages of Second Variation of Second Embodiment

According to a feature of the second variation of the second embodiment, the area of contact between the first circumferential wall (83) and the second circumferential wall (87) is reduced, so that it is possible to reduce the chances of the valve body (81) not returning toward the suction pipe (12) due to the viscosity of the lubricant between the first circumferential wall (83) and the second circumferential wall (87) during a stop of the scroll compressor (10).

Third Variation of Second Embodiment

Figure 21:
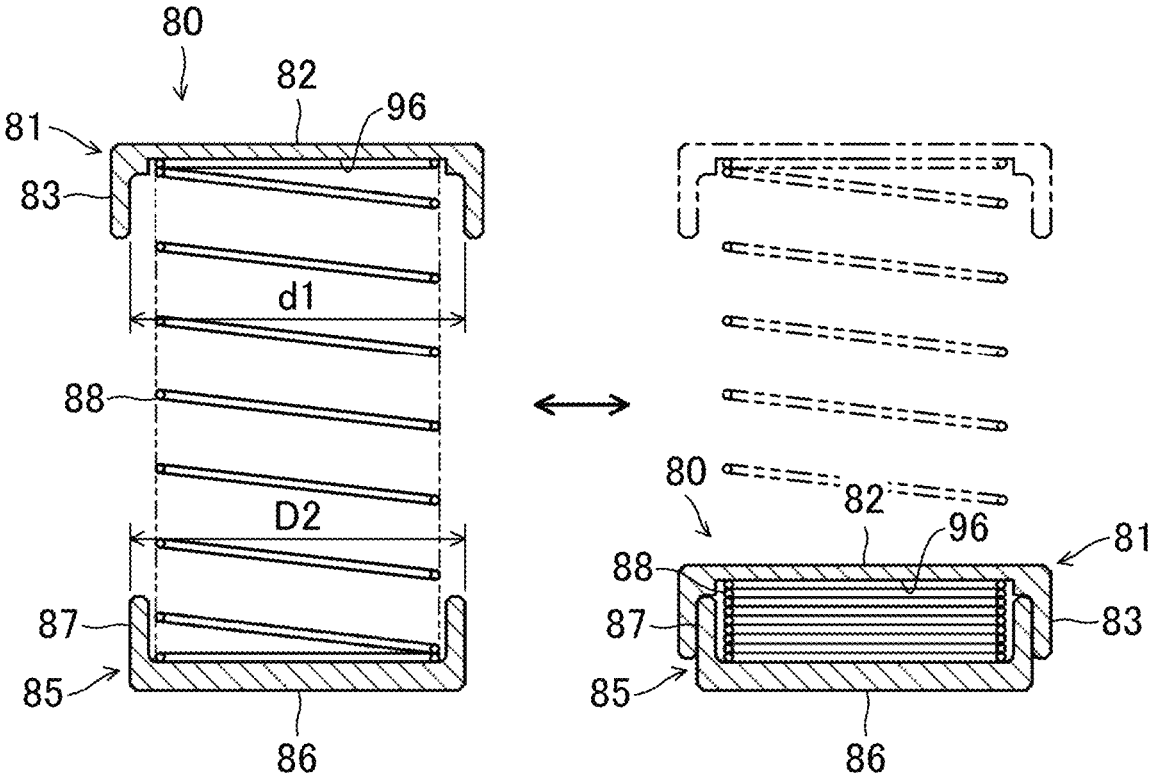
FIG. 21 illustrates cross-sectional side views of a configuration of a suction check valve according to a third variation of the second embodiment.

As illustrated in FIG. 21, a surface of the first bottom portion (82) of the valve body (81) near the valve seat (85) has a spring housing portion (96). The spring housing portion (96) is a recessed portion of the lower surface of the first bottom portion (82). The inside diameter of the spring housing portion (96) is larger than the outside diameter of the compression spring (88). The spring housing portion (96) houses an upper end portion of the compression spring (88).

Although not shown, the compression spring (88) is welded and joined to the first bottom portion (82) in the spring housing portion (96).

Advantages of Third Variation of Second Embodiment

According to a feature of the third variation of the second embodiment, it is possible to restrict the movement of the compression spring (88) in the radial direction.

Fourth Variation of Second Embodiment

Figure 22:
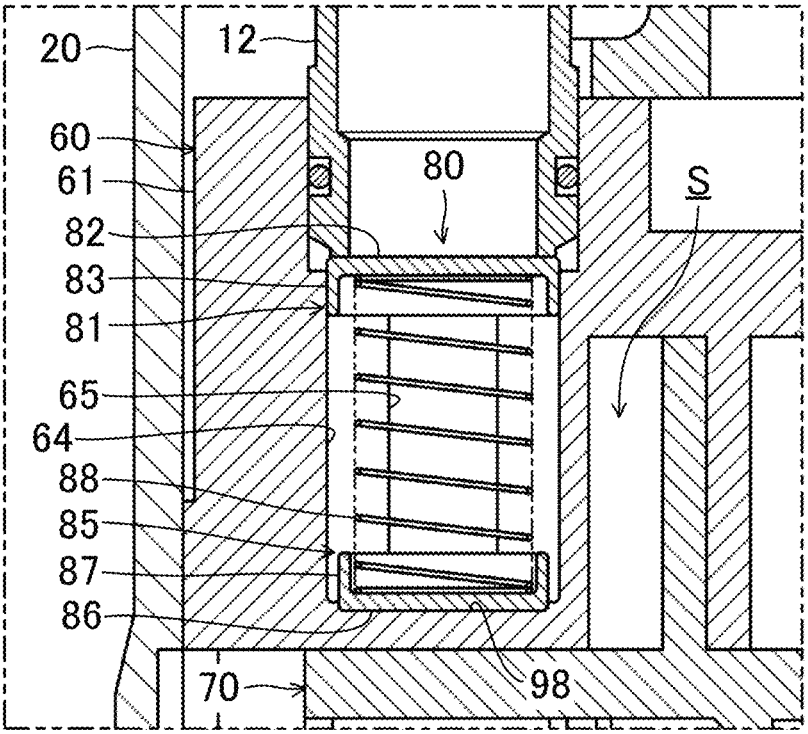
FIG. 22 is an enlarged view of a suction passage and its surrounding area in a state in which a suction check valve according to a fourth variation of the second embodiment is closed.

As illustrated in FIG. 22, the bottom surface in the suction passage (64) has a valve seat housing portion (98). The valve seat housing portion (98) is a recessed portion of the bottom surface of the suction passage (64). The valve seat (85) is housed in the valve seat housing portion (98).

Figure 23:
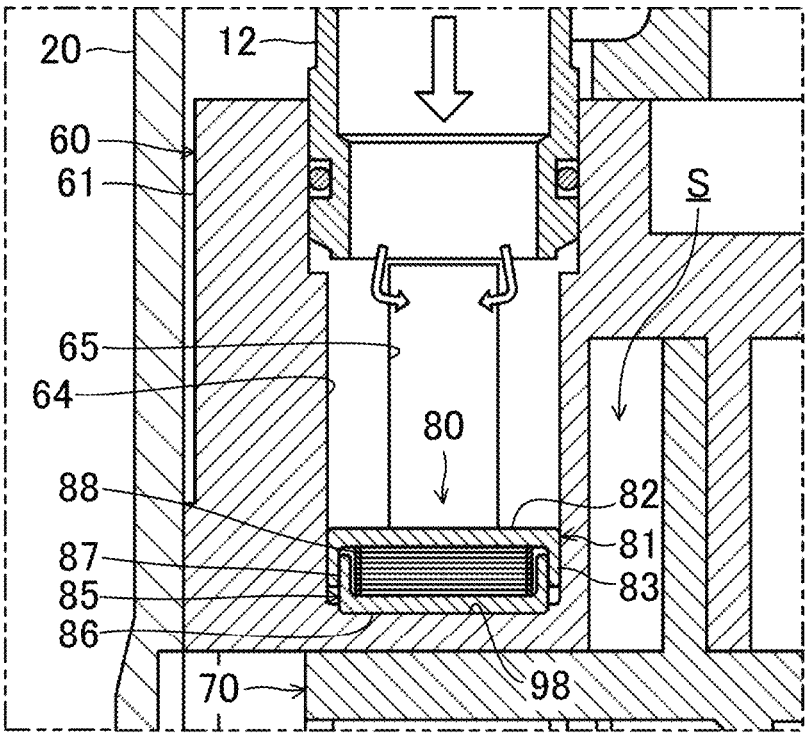
FIG. 23 is an enlarged view of the suction passage and its surrounding area in a state in which the suction check valve according to the fourth variation of the second embodiment is open.

The outside diameter of the valve body (81) is smaller than the inside diameter of the suction passage (64). As illustrated in FIG. 23, during operation of the scroll compressor (10), the valve body (81) moves along the inner circumferential surface of the suction passage (64) when the valve body (81) moves toward the valve seat (85) against the biasing force of the compression spring (88). The valve body (81) is therefore less likely to incline.

The outside diameter of the second circumferential wall (87) of the valve seat (85) is smaller than the inside diameter of the open end of the first circumferential wall (83) of the valve body (81). Thus, when the valve body (81) is moved toward the valve seat (85), a portion of the second circumferential wall (87) of the valve seat (85) is housed in on the inner side of the first circumferential wall (83) of the valve body (81) (see FIG. 23).

Advantages of Fourth Variation of Second Embodiment

According to a feature of the fourth variation of the second embodiment, it is possible to restrict the movement of the valve seat (85) in the radial direction in the suction passage (64).

Other Embodiments

The above-described embodiments may be modified as follows.

The first embodiment may be configured such that the bottom surface in the suction passage (64) has a valve seat housing portion (98) which is a recessed portion and houses the valve seat (85). It is this possible to restrict the movement of the valve seat (85) in the suction passage (64) in the radial direction.

The second embodiment may be configured such that the fixed scroll (60) has a connection passage (94) having one end open to the mounting surface on which the valve seat (85) is mounted, and the other end connected to the fluid chamber (S), and that the second bottom portion (86) has a communication hole (95) that communicates with the connection passage (94). According to this configuration, the refrigerant in the fluid chamber (S) flows between the valve body (81) and the valve seat (85) via the connection passage (94) and the communication hole (95) during a stop of the scroll compressor (10), which makes it possible to return the valve body (81) toward the suction pipe (12).

The second embodiment may also be configured such that the suction passage (64) extends along the axial direction of the suction pipe (12) and is open to the surface of the fixed scroll (60) facing the movable scroll (70), and that the valve seat (85) is fitted into the opening of the suction passage (64) to close the opening. It is this possible to restrict the movement of the valve seat (85) in the suction passage (64) in the radial direction.

In the foregoing embodiments, R513A and R1234yf have been raised as examples of the refrigerant applicable to the scroll compressor (10). R513A is a refrigerant mixture containing a hydrofluoroolefin (HFO) refrigerant. R1234yf is an HFO refrigerant.

In the foregoing embodiments and variations, the refrigerant applicable to the scroll compressor (10) is not limited to R513A and R1234yf. Examples of the HFO refrigerant or the refrigerant mixture containing the HFO refrigerant as the refrigerant applicable to the scroll compressor (10) include single-component refrigerants and refrigerant mixtures shown in the list of FIG. 24.

It will be understood that the embodiments and variations described above can be modified with various changes in form and details without departing from the spirit and scope of the claims. The elements according to embodiments, the variations thereof, and the other embodiments may be combined and replaced with each other. In addition, the expressions of "first," "second," "third," . . . , in the specification and claims are used to distinguish the terms to which these expressions are given, and do not limit the number and order of the terms.

As can be seen from the foregoing description, the present disclosure is useful for a scroll compressor and a refrigeration apparatus.

The invention claimed is:

1. A scroll compressor comprising:

a movable scroll;

a fixed scroll defining a fluid chamber together with the movable scroll, the fixed scroll having a suction passage that guides a refrigerant to the fluid chamber;

a suction pipe having one end portion inserted into the suction passage; and a suction check valve arranged in the suction passage, the suction check valve being configured to open and close an open end of the suction pipe, the suction check valve including a valve body configured to close the open end of the suction pipe, a valve seat arranged in the suction passage and facing the valve body, and a compression spring arranged between the valve body and the valve seat to bias the valve body toward the open end of the suction pipe, the valve body including a first bottom portion, and a first circumferential wall extending toward the valve seat along a peripheral portion of the first bottom portion, the valve seat including a second bottom portion, and a second circumferential wall extending toward the valve body along a peripheral portion of the second bottom portion, one of the first circumferential wall and the second circumferential wall having an outside diameter smaller than an innermost inside diameter of an open end of an other one of the first circumferential wall and the second circumferential wall, the valve body being movable between a position in which the first circumferential wall is spaced from the second circumferential wall and a position in which at least a portion of the one of the circumferential walls is housed on an inner side of the other circumferential wall.

2. The scroll compressor of claim 1, wherein an outside diameter D1 of the first circumferential wall and an inside diameter d2 of an open end of the second circumferential wall satisfy D1<d2.

3. The scroll compressor of claim 2, wherein an outer circumferential surface of the first circumferential wall has an outer groove that extends along a direction of expansion and contraction of the compression spring.

4. The scroll compressor of claim 2, wherein the fixed scroll has a connection passage having one end open to a mounting surface on which the valve seat is mounted, and an other end connected to the fluid chamber, and the second bottom portion has a communication hole that communicates with the connection passage.

5. The scroll compressor of claim 2, wherein a surface of the second bottom portion near the valve body has a spring housing portion which is a recessed portion and houses an end portion of the compression spring.

6. The scroll compressor of claim 2, wherein a bottom surface in the suction passage has a valve seat housing portion that is a recessed portion and houses the valve seat.

7. The scroll compressor of claim 1, wherein an inside diameter d1 of an open end of the first circumferential wall and an outside diameter D2 of the second circumferential wall satisfy D2<d1.

8. The scroll compressor of claim 7, wherein an outer circumferential surface of the second circumferential wall has an outer groove that extends along a direction of expansion and contraction of the compression spring.

9. The scroll compressor of claim 7, wherein the fixed scroll has a connection passage having one end open to a mounting surface on which the valve seat is mounted, and an other end connected to the fluid chamber, and the second bottom portion has a communication hole that communicates with the connection passage.

10. The scroll compressor of claim 7, wherein a surface of the first bottom portion near the valve seat has a spring housing portion that is a recessed portion and houses an end portion of the compression spring.

11. The scroll compressor of claim 7, wherein a bottom surface in the suction passage has a valve seat housing portion that is a recessed portion and houses the valve seat.

12. The scroll compressor of claim 1, wherein the refrigerant is R513A.

13. The scroll compressor of claim 1, wherein the refrigerant is R1234yf.

14. A refrigeration apparatus including the scroll compressor of claim 1, the refrigeration apparatus further comprising:

a refrigerant circuit through which a refrigerant compressed by the scroll compressor flows.

15. A scroll compressor comprising:

a movable scroll;

a fixed scroll defining a fluid chamber together with the movable scroll, the fixed scroll having a suction passage that guides a refrigerant to the fluid chamber;

a suction pipe having one end portion inserted into the suction passage; and a suction check valve arranged in the suction passage, the suction check valve being configured to open and close an open end of the suction pipe, the suction check valve including a valve body configured to close the open end of the suction pipe, a valve seat arranged in the suction passage and facing the valve body, and a compression spring arranged between the valve body and the valve seat to bias the valve body toward the open end of the suction pipe, the valve body including a first bottom portion, and a first circumferential wall extending toward the valve seat along a peripheral portion of the first bottom portion, the valve seat including a second bottom portion, and a second circumferential wall extending toward the valve body along a peripheral portion of the second bottom portion, an outside diameter D1 of the first circumferential wall and an innermost inside diameter d2 of an open end of the second circumferential wall satisfying D1<d2, and an inner circumferential surface of the second circumferential wall having an inner groove that extends along a direction of expansion and contraction of the compression spring.

16. A scroll compressor comprising:

a movable scroll;

a fixed scroll defining a fluid chamber together with the movable scroll, the fixed scroll having a suction passage that guides a refrigerant to the fluid chamber;

a suction pipe having one end portion inserted into the suction passage; and a suction check valve arranged in the suction passage, the suction check valve being configured to open and close an open end of the suction pipe, the suction check valve including a valve body configured to close the open end of the suction pipe, a valve seat arranged in the suction passage and facing the valve body, and a compression spring arranged between the valve body and the valve seat to bias the valve body toward the open end of the suction pipe, the valve body including a first bottom portion, and a first circumferential wall extending toward the valve seat along a peripheral portion of the first bottom portion, the valve seat including a second bottom portion, and a second circumferential wall extending toward the valve body along a peripheral portion of the second bottom portion, an outside diameter D1 of the first circumferential wall and an innermost inside diameter d2 of an open end of the second circumferential wall satisfying D1<d2, the suction passage extending along an axial direction of the suction pipe and being open to a surface of the fixed scroll that faces the movable scroll, and the valve seat being fitted into an opening of the suction passage to close the opening.

17. The scroll compressor of claim 16, wherein an inside diameter d3 of the suction passage and an inside diameter d2 of an open end of the second circumferential wall satisfy d3≤d2.

18. A scroll compressor comprising:

a movable scroll;

a fixed scroll defining a fluid chamber together with the movable scroll, the fixed scroll having a suction passage that guides a refrigerant to the fluid chamber;

a suction pipe having one end portion inserted into the suction passage; and a suction check valve arranged in the suction passage, the suction check valve being configured to open and close an open end of the suction pipe, the suction check valve including a valve body configured to close the open end of the suction pipe, a valve seat arranged to face the valve body, and a compression spring arranged between the valve body and the valve seat to bias the valve body toward the open end of the suction pipe, the valve body including a first bottom portion, and a first circumferential wall extending toward the valve seat along a peripheral portion of the first bottom portion, the valve seat including a second bottom portion, and a second circumferential wall extending toward the valve body along a peripheral portion of the second bottom portion, an inside diameter d1 of an open end of the first circumferential wall and an outside diameter D2 of the second circumferential wall satisfying D2<d1, and an inner circumferential surface of the first circumferential wall having an inner groove that extends along a direction of expansion and contraction of the compression spring.

19. A scroll compressor comprising:

a movable scroll;

a fixed scroll defining a fluid chamber together with the movable scroll, the fixed scroll having a suction passage that guides a refrigerant to the fluid chamber;

a suction pipe having one end portion inserted into the suction passage; and a suction check valve arranged in the suction passage, the suction check valve being configured to open and close an open end of the suction pipe, the suction check valve including a valve body configured to close the open end of the suction pipe, a valve seat arranged to face the valve body, and a compression spring arranged between the valve body and the valve seat to bias the valve body toward the open end of the suction pipe, the valve body including a first bottom portion, and a first circumferential wall extending toward the valve seat along a peripheral portion of the first bottom portion, the valve seat including a second bottom portion, and a second circumferential wall extending toward the valve body along a peripheral portion of the second bottom portion, an inside diameter d1 of an open end of the first circumferential wall and an outside diameter D2 of the second circumferential wall satisfying D2<d1, the suction passage extending along an axial direction of the suction pipe and being open to a surface of the fixed scroll that faces the movable scroll, and the valve seat being fitted into an opening of the suction passage to close the opening.

* * * * *